US008597079B2

(12) United States Patent
Wiand et al.

(10) Patent No.: US 8,597,079 B2
(45) Date of Patent: Dec. 3, 2013

(54) ABRASIVE WHEEL WITH CLOSED PROFILES IN CUTTING SURFACE

(75) Inventors: Ronald C. Wiand, Troy, MI (US); Dennis R. Raffaelli, Oxford, MI (US)

(73) Assignee: Inland Diamond Products Company, Madison Heights, MI (US)

( * ) Notice: Subject to any disclaimer, the term of this patent is extended or adjusted under 35 U.S.C. 154(b) by 302 days.

(21) Appl. No.: 12/930,451

(22) Filed: Jan. 7, 2011

(65) Prior Publication Data

US 2012/0178345 A1 Jul. 12, 2012

(51) Int. Cl.
*B24B 1/00* (2006.01)

(52) U.S. Cl.
USPC ..... 451/42; 451/541; 451/547

(58) Field of Classification Search
USPC ..... 451/42, 53, 449, 488, 541, 544, 547
See application file for complete search history.

(56) References Cited

U.S. PATENT DOCUMENTS

| | | | | | |
|---|---|---|---|---|---|
| 2,049,874 | A | | 8/1933 | Sherk | |
| 3,711,999 | A | | 1/1973 | Held | |
| 3,841,034 | A | * | 10/1974 | Held | 451/488 |
| 3,916,579 | A | * | 11/1975 | Waller et al. | 451/547 |
| 4,286,415 | A | | 9/1981 | Loreto | |
| 4,885,875 | A | | 12/1989 | Soper | |
| 5,052,154 | A | * | 10/1991 | Lehmann | 451/542 |
| 5,053,971 | A | | 10/1991 | Wood et al. | |
| 5,384,987 | A | | 1/1995 | Wiand | |
| 5,611,724 | A | * | 3/1997 | deGraaff | 451/53 |
| 5,655,958 | A | * | 8/1997 | Lupi | 451/342 |
| 5,727,987 | A | * | 3/1998 | Gottschlad | 451/5 |
| 5,846,125 | A | * | 12/1998 | Robichon | 451/450 |
| 5,951,381 | A | | 9/1999 | Videcoq et al. | |
| 6,074,278 | A | | 6/2000 | Wu et al. | |
| 6,840,851 | B1 | * | 1/2005 | Raffaelli | 451/547 |
| D660,331 | S | * | 5/2012 | Raffaelli | D15/126 |
| 2005/0064799 | A1 | * | 3/2005 | Raffaelli | 451/42 |
| 2007/0178813 | A1 | * | 8/2007 | Raffaelli | 451/42 |
| 2009/0117830 | A1 | * | 5/2009 | Raffaelli | 451/42 |

FOREIGN PATENT DOCUMENTS

| | | | |
|---|---|---|---|
| DE | 195 38 841 | A1 | 2/1997 |
| EP | 1518647 | A2 | 3/2005 |
| FR | 2 413 182 | A | 7/1979 |
| JP | 57003561 | U | 1/1982 |
| JP | A 52 121889 | | 10/1997 |
| JP | 2000 354969 | A | 12/2000 |
| WO | WO 02/26432 | | 4/2002 |

OTHER PUBLICATIONS

Krey Optical brochure; retrieved Sep. 18, 2003 from "www.krey-optical.com/material.htm"; 4 pages.
PPG Optical Monomers and Coatings brochure; retrieved Sep. 18, 2003 from www.ppg.com/chm_optical/trivex_ppg.htm; 3 pages.

* cited by examiner

*Primary Examiner* — Eileen P. Morgan
(74) *Attorney, Agent, or Firm* — Warn Partners, P.C.

(57) ABSTRACT

Ophthalmic abrasive wheel including a plurality of swarf clearing grooves formed across the cutting surface and having closed profiles such that the swarf clearing grooves do not open to or exit the side of the abrasive wheel. The swarf clearing grooves are spaced around the cutting surface of the wheel and are configured so as to be substantially angled either towards or away from one another.

18 Claims, 1 Drawing Sheet

ABRASIVE WHEEL WITH CLOSED PROFILES IN CUTTING SURFACE

FIELD OF THE INVENTION

The present invention relates generally to rough-cut and polishing grinding wheels of the type used for surfacing and edging of an optical lens for reducing the necessary manual removal of swarf from the lens after rough cutting, fine grinding, finishing, polishing, and/or beveling of an optical lens, so as to improve lens quality and/or geometry.

BACKGROUND OF THE INVENTION

Optical lenses are typically made of various materials, such as polycarbonates and high index plastics, as well as those materials currently marketed under the trade names CR39® and TRIVEX™ (both readily commercially available from PPG Industries, Pittsburgh, Pa.). In order to finish and make these lenses ready for fitting into a lens frame, it is necessary to edge the outer periphery of the lens, to give it the proper cross-section to fit in an eyeglass lens frame. Typically, this is done by an edging machine, which includes a rough-cut wheel for cutting out the shape, fine surfacing and edging wheels for further shaping of the lens, and polishing and beveling wheels for providing the final contour. Depending on the lens material, the grinding operation creates abrasive swarf material that requires removal in order for proper use of any type of abrasive device. Typically, the wheels have buildup of swarf during the operation, which imparts itself onto the lens or, alternatively, the grinding process does not remove the excess material. This creates the need to manually remove the swarf from the lens. Any swarf that is not readily removed during the grinding of the edging operation, interferes with the operation and, at the very least, slows it down and may add to several hand finishing steps necessary at the end, or an improper lens configuration.

TRIVEX™ has been a particularly troublesome material to shape and finish. However, TRIVEX™ does appear to be a new and preferred lens making material. Unfortunately, conventional forming wheels have resulted in much scrap and have otherwise been proved to be unsuitable for use with TRIVEX™ materials for lenses. Therefore, it has become a goal to provide an abrasive wheel capable of processing TRIVEX™ lenses that can also be used for all other type of lens materials. In the optical industry today, the "one-hour" optical labs and the like have made it necessary for increased efficiencies in the processing of optical lens production. Therefore, it is desired to eliminate swarf removal on the optical lens by hand, regardless of the material used, which is labor intensive and time consuming.

Therefore, it is a goal in the art to provide surfacing and edging wheels and methods for using the same that help to substantially reduce or eliminate the need for manual ground lens swarf removal.

SUMMARY OF THE INVENTION

In accordance with the present invention, a rotary edging wheel for rough cutting of an optical lens is provided, comprising a hub portion operable for attachment to a rotary power source, an outer circumferential cutting surface having a width, said surface including an abrasive grit attached thereto, wherein said abrasive grit is operable for grinding of the optical lens; and at least one pair of adjacent swarf clearing grooves formed in said outer circumferential cutting surface, comprising a first swarf clearing groove extending at an angle partly across said surface; and a second swarf clearing groove extending at an angle partly across said surface; wherein said first and second swarf clearing grooves are angled either towards each other or away from each other and extend continuously across said surface, but do not exit the side of the wheel, e.g., do not extend completely across the outer circumferential cutting surface. The wheel includes first and second radially extending planar side portions. The first and second swarf clearing grooves extend at an angle to the first and/or second planar side portion and do not exit the edges of the outer circumferential cutting surface, e.g., do not open into the first and/or second planar side portions. Centrifugal forces during rotation of the wheel and the configuration and angle of the swarf clearing grooves causes the ground lens swarf to be removed from the grinding interface, e.g., without necessitating the use of grinding fluid, which is an undesirable necessity with conventional grinding wheels.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Although the following description primary concerns rough cutting and polishing wheels for use with optical lens blanks, it should be appreciated that the present invention can be practiced with any type of surfacing wheel wherein removal of swarf material is desirable. By way of non-limiting example, the present invention can be applied to any number of types of surfacing wheels and applications including rough cutting wheels, fine grinding wheels, finishing wheels, polishing wheels, edging wheels, beveling wheels, pencil edging wheels, e.g., with grooves in the bottom of the abrasive profile, optical beveling wheels, e.g., with grooves only in the Vee area, Ogee wheels, e.g., with grooves only in the center of the profile and no grooves across the wheel, Arris wheels, e.g., with grooves only in the bottom of the form, LCD wheels, CNC routers, table top routers, and the like. Additionally, the present invention can be practiced with any type of optical lens blank material including polycarbonates and high index plastics, as well as those materials currently marketed under the trade names CR39® and TRIVEX™. It is further understood that the present invention can be practiced with glass work pieces and the like.

Figure 1:
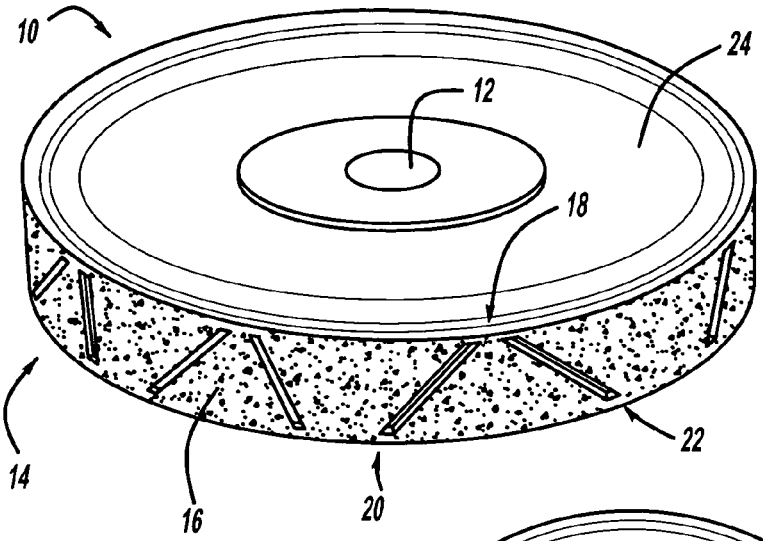
FIG. 1 is a perspective view of an abrasive wheel, in accordance with the present invention.
Figure 2:
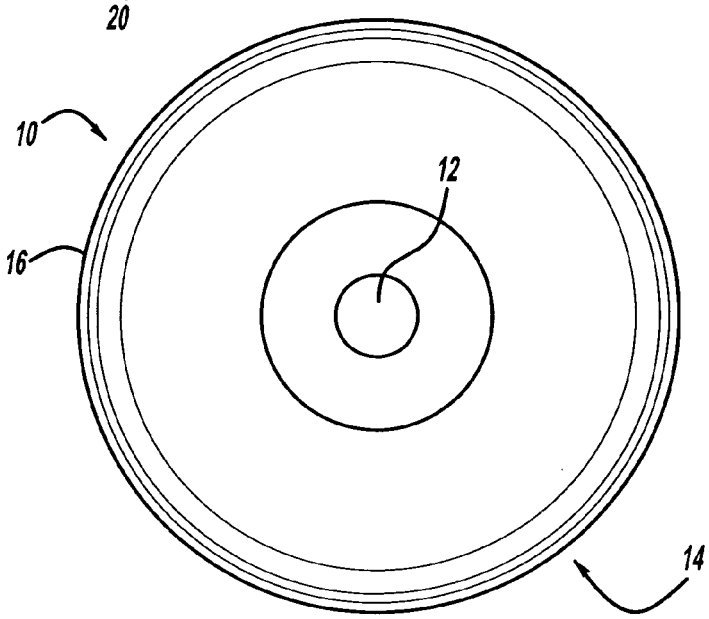
FIG. 2 is a top plan view of the abrasive wheel depicted in FIG. 1, in accordance with the present invention.
Figure 3:
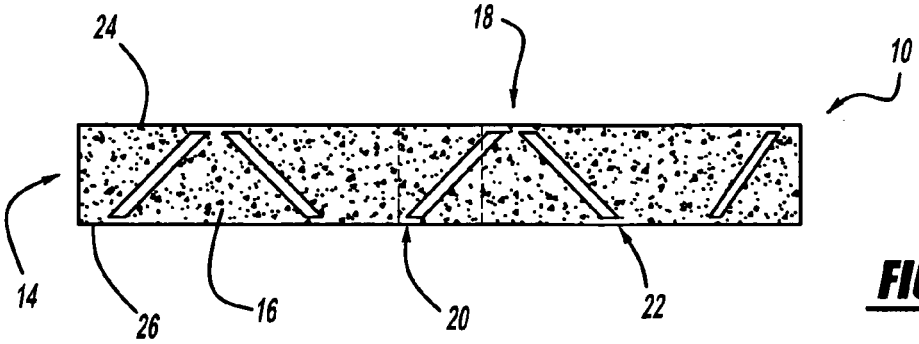
FIG. 3 is a side plan view of the abrasive wheel depicted in FIGS. 1 and 2, in accordance with the present invention.

Referring to FIGS. 1-3 in general, an abrasive wheel for rough cutting or polishing of an optical lens is generally shown at 10. The abrasive wheel 10 includes a hub portion, generally shown at 12, and an outer circumferential cutting surface, generally shown at 14, including a width W. The outer circumferential cutting surface 14 includes an abrasive grit material 16 that is attached thereto for grinding of the lens blank material. The abrasive wheel 10 includes at least one pair 18 of adjacent swarf clearing grooves 20,22, respectively, and radially extending first outer planar side portion 24 and second spaced and opposed outer planar side portion 26. The at least one pair 18 of adjacent swarf clearing grooves 20,22 extend partly across the width W of the outer circumferential cutting surface 14 of the abrasive wheel 10 such that they terminate inboard of the edges of the cutting surface, e.g., are contiguous from a location inboard from a first outer edge 28 of the first outer planar side portion 24 surface, e.g., inboard by about 0.5 to 3 millimeters, preferably by about 1 to 2 millimeters, to a location inboard from a second outer edge 30 of the second outer planar side portion 26 surface, e.g., inboard by about 0.5 to 3 millimeters, preferably by about 1 to 2 millimeters. The first and second swarf clearing grooves 20,22 extend at an angle to the first and/or second planar side portions 24,26 and do not exit the edges 28,30 of the outer circumferential cutting surface 14, e.g., do not open into the first and/or second planar side portions 24,26. The centrifugal forces during rotation of the abrasive wheel 10 and the shape, configuration and angle of the swarf clearing grooves 20,22 causes the ground lens swarf to be removed from the grinding interface.

The grooves 20,22, are preferably configured so as to be either angled towards and/or angled away from one another. By way of a non-limiting example, each of the grooves 20,22, respectively, can be angled from about 20 degrees to about 165 degrees in relation to either outer planar side portion 24,26, respectively. In accordance with a preferred embodiment of the present invention, each of the grooves 20,22, respectively, can be angled from about 1 degree to about 89 degrees and/or from about 91 degrees to about 179 degrees in relation to either outer planar side portion 24,26, respectively. In accordance with a more preferred embodiment of the present invention, each of the grooves 20,22, respectively, can be angled from about 70 degrees to about 100 degrees in relation to either outer planar side portion 24, 26, respectively. In accordance with a preferred embodiment of the present invention, each of the grooves 20,22, respectively, can be angled from about 10 degrees to about 80 degrees in relation to either outer planar side portion 24,26, respectively. In accordance with a more preferred embodiment of the present invention, each of the grooves 20,22, respectively, can be angled from about 15 degrees to about 65 degrees in relation to either outer planar side portion 24, 26, respectively. In accordance with a highly preferred embodiment of the present invention, each of the grooves 20,22, respectively, can be angled from about 35 degrees to about 45 degrees in relation to either outer planar side portion 24,26, respectively. Additionally, by way of non-limiting example, terminating ends of each of the grooves 20,22 can be spaced apart by a distance of about 1 to 4 millimeters, preferably about 1 to 2 millimeters.

Regardless of the angle chosen, each groove 20,22, respectively, should preferably have the same angle, e.g., if groove 20 is angled 45 degrees away from outer planar side portion 24, then groove 22 should also be angled 45 degrees away from outer planar side portion 24 in the same and/or opposite orientation. In accordance with a preferred embodiment of the present invention, each groove is a mirror image of the other spaced and opposed groove.

Each of the grooves 20,22, respectively, preferably has planar sides 32,34, respectively, that extend substantially perpendicular to either outer planar side portions 24,26, respectively, to further assist with swarf removal during rotating of the abrasive wheel 10.

In accordance with a preferred embodiment of the present invention, multiple pairs 18 of adjacent swarf clearing grooves are employed in the practice of the present invention. In accordance with a more preferred embodiment of the present invention, at least two to at least twenty grooves can be employed. In accordance with a highly preferred embodiment of the present invention, at least six to at least sixteen grooves are employed. In accordance with a preferred embodiment of the present invention, about one-half to about three grooves are provided for per inch of the outer circumferential cutting surface 14. In accordance with a preferred embodiment of the present invention, the surface area of the wheel that comprises the groove area is preferably in the range of about 6% to about 60%, and more preferably in the range of about 20% to about 30%.

In accordance with a preferred embodiment of the present invention, the width and/or depth of either of the grooves 20,22, respectively, is in the range of about 1 to about 10 millimeters. In accordance with a preferred embodiment of the present invention, the length of either of the grooves 20,22, respectively, is in the range of about 1 to about 35 and preferably 20-30 millimeters. However, it should be appreciated that the width, depth, and/or length of the grooves of the present invention can be modified without departing from the scope of the present invention.

Preferably, a monolayer of brazed diamond or diamond like hardness materials are used, however, a surface thickness of a material is also contemplated. The exact grit rating of the abrasive grit material 16 is not thought to be critical to the success of the present invention, provided that the abrasive grit material 16 of the present invention is operable to rough cut any conventional optical lens materials, such as but not limited to polycarbonates and high index plastics, as well as those materials currently marketed under the trade names CR39® and TRIVEX™. In accordance with a preferred embodiment of the present invention, the grit rating of the abrasive grit material 16 is preferably in the range of about 20 to about 80, more preferably in the range of about 60 to about 80, and still more preferably in the range of about 60 to about 70. It should be appreciated that grit rating outside of these ranges, i.e., less than 20 and/or greater than 80, may be used as well in the practice of the present invention, should circumstances require (e.g., material specific requirements).

The abrasive grit material 16 can be attached by brazing the abrasive grit onto the circumferential cutting surface 14 of the wheel 10. However, the abrasive grit material 16 may also be attached to the cutting surface 14 by sintering electroplating or resin bonding. The abrasive grit material 16 is preferably comprised of a diamond-like hardness abrasive grit. However, other materials such as silicon carbides, tungsten carbides, oxides, garnets, cubic boron nitride, and natural and synthetic diamonds may be used alone or in combination in the present invention.

Grinding wheels made in accordance with the present invention are readily used in rough cutting, edging, shaping, finishing, and/or polishing machines. By way of non-limiting example, for polishing wheels intended for fine grinding and/or polishing of the optical lens, it is instead preferred to use an abrasive grit material that is much finer and thus less abrasive than the abrasive grit material 16 used for the abrasive wheel 10. In accordance with a preferred embodiment of the present invention, the grit rating of the abrasive grit material for fine polishing is preferably in the range of about 80 to about 600. It should be appreciated that grit rating outside of these ranges, i.e., less than 80 and/or greater than 600, may be used as well in the practice of the present invention, should circumstances require (e.g., material specific requirements).

It should be appreciated that a plurality of pairs 18 of adjacent swan clearing grooves may be employed in the practice of the present invention. The intended purpose of the swan clearing grooves 20,22, respectively, is for removal or swarf during grinding of the lens. It is further contemplated that two additional grooves can be provided in proximity to grooves 20,22, respectively. It is further understood that the grooves can, alternatively, be curved with respect to either outer planar side portions 14,16. It is further contemplated that two additional curved grooves can be provided in proximity to the curved grooves, respectively, e.g., a second pair of adjacent swan clearing grooves formed in the surface comprising third and fourth substantially parallel second swarf clearing grooves extending at an angle partly across the cutting surface. It is further contemplated that the curved grooves can, alternatively, be substantially serpentine in configuration, as opposed to being gradually curved. It is understood that two additional serpentine grooves can be provided in proximity to the serpentine grooves, respectively. It is further contemplated that the curved grooves can, alternatively, be substantially zigzagged in configuration, as opposed to being gradually curved. It is understood that two additional zigzagged grooves can be provided in proximity to the serpentine grooves, respectively. It should also be appreciated that other configurations may be employed with the grooves of the present invention.

The use of the described abrasive wheel 10, whether for rough cutting, fine grinding, finishing, polishing, beveling, or the like, is fairly straightforward. The abrasive wheel 10 is preferably mounted to a rotary motion machine, which preferably allows the abrasive wheel 10 to selectively rotate about an axis, wherein at least a portion of the cutting face is accessible (e.g., by a work piece such as an optical lens blank). The abrasive wheel 10 is then rotated while an optical lens blank is brought into contact with the rotating abrasive wheel 10 for a sufficient period of time. As swarf material is generated by the frictional engagement, the swarf material is preferably carried away from the surface of the optical lens blank and/or the abrasive wheel 10 by the grooves 20,22 of the present invention. It should also be appreciated that other configurations may be employed with the grooves 20,22 of the present invention.

It will be appreciated that the choice of wheel will be dependent, in part, on the particular action to be carried out, e.g., rough cutting, fine grinding, finishing, polishing, beveling, or the like. Thus, in the production of a particular finished optical lens, it may be necessary to employ multiple types of wheels, e.g., one for rough cutting, one for fine grinding, one for finishing, one for polishing, one for beveling, and so forth, to perform the required cutting, grinding, finishing, polishing, or beveling functions.

Testing of the wheels of the present invention have shown an increase in the ease of swarf material removal during the grinding process, a reduction in the number of burrs on the edge surfaces of the optical lens blanks, a reduction in grinding noise levels, a reduction or elimination in grinding fluid, e.g., coolant, and a reduction in odor levels due to the grinding process. Additionally, wheels of the present invention cut cool enough to allow grinding of TRIVEX™ and polycarbonate lens materials substantially without melting. The present invention allows cooler cutting and improved edge finishing qualities whether in rough cutting, finish cutting or polishing operations.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. An abrasive wheel for grinding of an optical lens, comprising:

a hub portion operable for attachment to a rotary power source;

first and second radially extending planar side portions;

an outer circumferential cutting surface having a width, said surface including an abrasive grit attached thereto, wherein said abrasive grit is operable for rough cutting of optical lens blank material; and at least one pair of adjacent swarf clearing grooves formed in said outer circumferential cutting surface, comprising:

a first swarf clearing groove extending at an angle to said first and second planar side portions across said outer circumferential cutting surface; and a second swarf clearing groove extending at an angle to said first and second planar side portions across said outer circumferential cutting surface;

wherein said first and second swarf clearing grooves are angled either towards each other or away from each other and extend continuously across the width of said outer circumferential cutting surface and do not exit first and second outer edges of the outer circumferential cutting surface to said first and second radially extending planar side portions; and wherein each of said first and second swarf clearing grooves is a mirror image of the other spaced and opposed swarf clearing groove with respect to an axis extending from said first radially extending planar side portion to said second radially extending planar side portion and terminate about 0.5 to 3 millimeters inboard from said first and second outer edges of the outer circumferential cutting surface and wherein terminal ends of said first and second swarf clearing grooves are parallel to said first and second planar side portions.

2. The abrasive wheel of claim 1, further comprising a plurality of pairs of adjacent swarf clearing grooves formed in said outer circumferential cutting surface.

3. The abrasive wheel of claim 1, wherein each swarf clearing groove has an angle of from about 10 degrees to about 80 degrees.

4. The abrasive wheel of claim 1, wherein each swarf clearing groove has an angle of from about 15 degrees to about 65 degrees.

5. The abrasive wheel of claim 1, wherein each swarf clearing groove has an angle of from about 35 degrees to about 45 degrees.

6. The abrasive wheel of claim 1, wherein said abrasive grit is attached to the abrasive wheel by brazing, electroplating, sintering or resin bonding.

7. The abrasive wheel of claim 1, wherein said abrasive grit is comprised of diamond or diamond hardness grit.

8. The abrasive wheel of claim 1, wherein said abrasive grit is comprised of a monolayer of brazed diamond or diamond like hardness materials.

9. The abrasive wheel of claim 1, wherein terminating ends of said first and second swarf clearing grooves are spaced apart by a distance of about 1 to 2 millimeters.

10. A method for grinding of an optical lens, comprising:

providing an abrasive wheel, comprising:

a hub portion operable for attachment to a rotary power source;

first and second radially extending planar side portions;

an outer circumferential cutting surface having a width, said surface including an abrasive grit attached thereto, wherein said abrasive grit is operable for grinding of optical lens blank material; and at least one pair of adjacent swarf clearing grooves formed in said surface, comprising:

a first swarf clearing groove extending at an angle to said first and second planar side portions across said surface; and a second swarf clearing groove extending at an angle to said first and second planar side portions across said surface;

wherein said first and second swarf clearing grooves are angled either towards each other or away from each other and extend continuously across the width of said outer circumferential cutting surface and do not exit first and second outer edges of the outer circumferential cutting surface to said first and second radially extending planar side portions; and wherein each of said first and second swarf clearing grooves is a mirror image of the other spaced and opposed swarf clearing groove with respect to an axis extending from said first radially extending planar side portion to said second radially extending planar side portion and terminate about 0.5 to 3 millimeters inboard from said first and second outer edges of the outer circumferential cutting surface and terminal ends of said first and second swarf clearing grooves are parallel to said first and second outer edges;

selectively rotating said edging wheel; and bringing the optical lens into selective contact with said abrasive wheel.

11. The method of claim 10, further comprising a plurality of pairs of adjacent swarf clearing grooves formed in said the outer circumferential cutting surface.

12. The method of claim 10, wherein each swarf clearing groove has an angle of from about 10 degrees to about 80 degrees.

13. The method of claim 10, wherein each swarf clearing groove has an angle of from about 15 degrees to about 65 degrees.

14. The method of claim 10, wherein each swarf clearing groove has an angle of from about 35 degrees to about 45 degrees.

15. The method of claim 10, wherein said abrasive grit is attached to the wheel by brazing, electroplating, sintering or resin bonding.

16. The method of claim 10, wherein said abrasive grit is comprised of diamond or diamond hardness grit.

17. The method of claim 10, wherein said abrasive grit is comprised of a monolayer of brazed diamond or diamond like hardness materials.

18. The abrasive wheel of claim 10, wherein terminating ends of said first and second swarf clearing grooves are spaced apart by a distance of about 1 to 2 millimeters.

* * * * *

UNITED STATES PATENT AND TRADEMARK OFFICE

CERTIFICATE OF CORRECTION

PATENT NO. : 8,597,079 B2
APPLICATION NO. : 12/930451
DATED : December 3, 2013
INVENTOR(S) : Ronald C. Wiand and Dennis R. Raffaelli It is certified that error appears in the above-identified patent and that said Letters Patent is hereby corrected as shown below:

In the Specification

Column 5, Line 2 “swan” should be -- swarf --;

Column 5, Line 4 “swan” should be -- swarf --;

Column 5, Line 4 “or” should be -- of --;

Column 5, Line 12 “swan” should be -- swarf --.

Signed and Sealed this
Thirtieth Day of September, 2014

Michelle K. Lee

Michelle K. Lee
*Deputy Director of the United States Patent and Trademark Office*